United States Patent [19]

Knuppertz et al.

[11] 4,077,621

[45] Mar. 7, 1978

[54] BOTTLE LABELING MACHINE

[75] Inventors: Heinz-Werner Knuppertz, Dusseldorf-Reisholz; Hans Lederer, Meerbusch, both of Germany

[73] Assignee: Jagenberg-Werke AG, Dusseldorf, Germany

[21] Appl. No.: 760,210

[22] Filed: Jan. 17, 1977

Related U.S. Application Data

[63] Continuation of Ser. No. 597,277, Jul. 18, 1975, abandoned.

[30] Foreign Application Priority Data

Jul. 26, 1974 Germany ..... 24360030

[51] Int. Cl.[2] ..... B65C 9/16; B65H 3/20

[52] U.S. Cl. ..... 271/33; 118/220; 118/231; 156/568; 156/571; 156/DIG. 29; 156/DIG. 32

[58] Field of Search ..... 156/568, 567, 571, DIG. 29, 156/DIG. 32; 271/95, 115, 270, 33, 38; 118/231, 220, 236

[56] References Cited

U.S. PATENT DOCUMENTS

| | | | |
|---|---|---|---|
| 3,385,595 | 5/1968 | Benatar et al. | 271/95 |
| 3,546,047 | 12/1970 | Dullinger | 156/568 X |
| 3,567,559 | 3/1971 | Dullinger | 271/95 X |
| 3,723,228 | 3/1973 | Schaltegger | 156/571 X |

*Primary Examiner*—William A. Powell
*Assistant Examiner*—M. G. Wityshyn
*Attorney, Agent, or Firm*—Burgess, Dinklage & Sprung

[57] ABSTRACT

A bottle labeling machine is provided with a rotating support which carries a pickup element past a gluing station, a label magazine to pick up a label and a label transfer station. Supplementary means are provided to rotate the pickup element either clockwise or counter-clockwise so as to speed it up or slow it down relative to the stations for matching its speed to that required at each station to effect a smooth pass at each station. A pair of cam followers are provided operating on two independent tracks with two lever arms connecting them to the supplementary means for rotating the pickup element. The lever arms may be rigid as one and have an intermediate axis about which they pivot or they may be independently pivoted at one end about one of the cam followers, the other end of one arm being connected to the second cam follower and the other end of the second arm being connected to the supplementary rotating means.

5 Claims, 10 Drawing Figures

BOTTLE LABELING MACHINE

Figure 1:
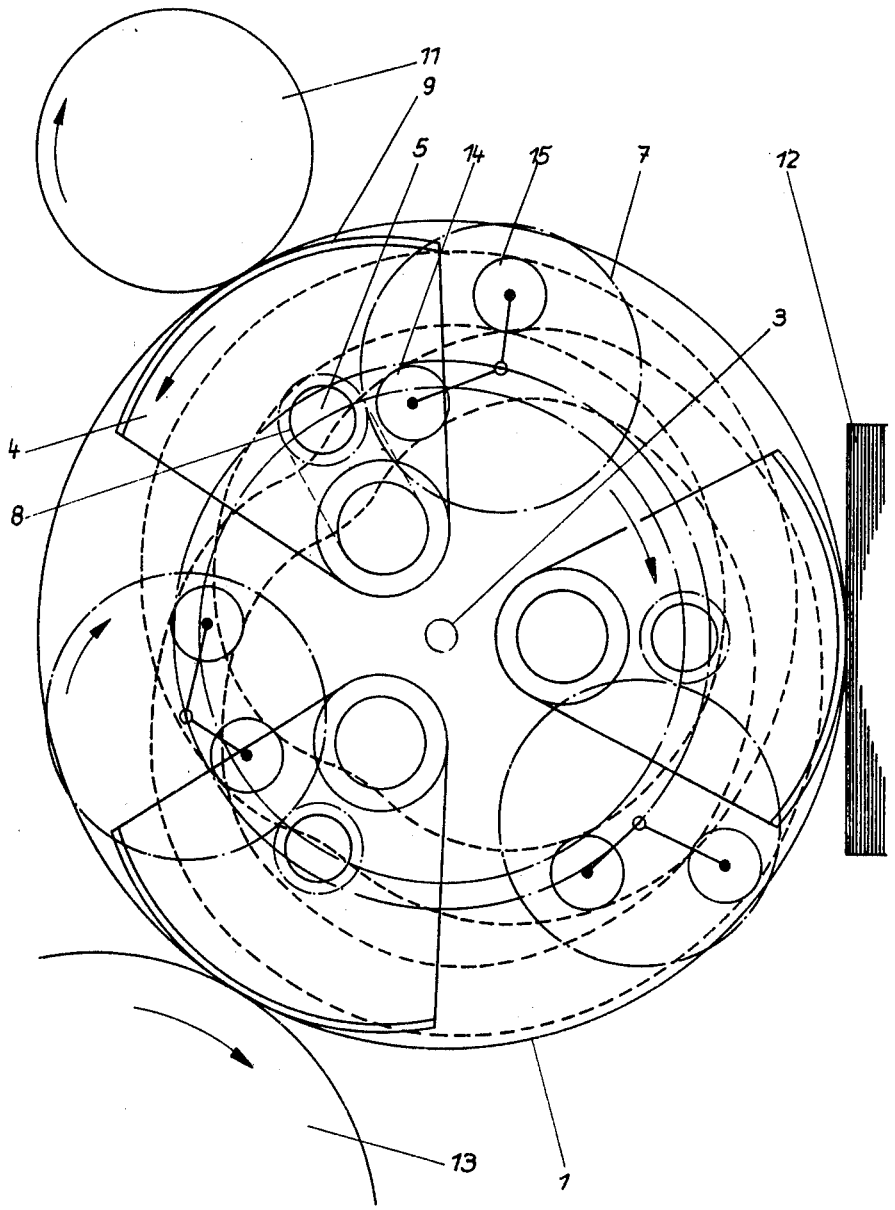

This is a continuation of application Ser. No. 597,277, filed July 18, 1975, now abandoned.

This invention relates to a labeling machine for objects such as bottles, wherein there are disposed in series along a track, several stations, viz, a gluing station, a label storage station including a label magazine containing a stack of labels, and a label transfer station. The apparatus also includes at least one label-pickup element pivotally mounted on a rotating support and successively passing the stations during each rotation of the support, the element having an outwardly curved label-pickup-transfer surface which during each cycle rolls over the topmost label and possibly over the other stations, and having a control member guided along a fixed cam track which, depending on the cam shape, accelerates or decelerates the rotation of the pickup element to adapt to the form and the relative speed of the surfaces in contact with the pickup element and at least of the label, and if desired also of the other stations.

U.S. Pat. No. 3,919,040 issued Nov. 11, 1975 on application Ser. No. 426,995, filed Dec. 20, 1973, discloses a labeling machine of this sort, wherein the control member guided along the cam track is coupled to a differential gear provided with a fixed sun wheel, a pinion mating therewith and a rocker arm. The main disadvantage of this known apparatus resides in the fact that the gearing necessary for the acceleration and deceleration of the rotation of the pickup elements is extremely costly, while the capacity of the machine is limited on account of the many moving parts required.

A further disadvantage of the machine is that in spite of the controlled differential gear it is not possible to obtain ideal rolling of the pickup-transfer surface of the pickup element against the usually flat surface of the topmost label of the pile of labels or against the usually cylindrical surface of the gluing device and the transfer-roll-off device, because the pickup element has the shape of a cylinder and is centrally supported. Even if there is a maximum adaptation of the control member and the setting of the differential gear, a precise roll-off motion between the pickup element and the topmost label of the fixed label box can only be achieved within the range of the tangential contact of the sheet-like form (label) with the round surface of the pickup element. For the same reasons there is also insufficient roll-off at the cylindrical stations.

It is accordingly an object of the invention to provide a labeling machine, with which the acceleration and deceleration of the rotary motion of the pickup element, which are required for a perfect rolling process, are obtained by simpler means.

This objective is realized according to the invention by providing such a labeling machine with at least two cam tracks along which respective cam followers disposed at a fixed distance from each other and rotatably bearing upon a label pickup element by means of lever arms, run so that when the support is rotating the pickup element turns in the same direction about its axis due to the shape of the cam track and the angular position of the lever arms.

The drive of the pickup elements of the labeling apparatus has been conceptualized in a simple manner, as the two cam tracks not only effect acceleration and deceleration of the rotary motion of the pickup elements, but also the rotation of such pickup elements via the two feeler-controlled lever arms. Because of the few moving parts, the cost in comparison with machines with a differential gear is substantially less, the machine being also practically maintenance-free and offering the possibility of operating at a higher capacity.

According to one alternative the drive of the pickup element can be so designed that the followers or feelers of a control member are at a fixed distance from their common shaft, particularly that of the pickup element, and their lever arms form a fixed angle. According to a second alternative, the control member is in the form of a crank assembly, one cam follower of which has a fixed distance from an axis of rotation, particularly that of the pickup element, and the other cam follower of which pivots around the first feeler and a fixed point relative to the axis of rotation.

There are various possibilities for the arrangement of the cam tracks. They are preferably arranged on two levels and their projections on a horizontal surface intersect. To further simplify the apparatus, the cam tracks may consist of curve segments disposed only in those areas where one and/or the other feeler must be supported to supply a rotation moment to the pickup element. In order to obtain as large a rotation as possible of the pickup element on a short cam segment, a transmission gear is disposed between the followers bearing upon the support and the associated pickup element.

The invention is further explained below with reference to the accompanying drawings representing examples of two embodiments. Specifically, FIG. 1 is a diagrammatic top view of a labeling station of a labeling machine, FIG. 2 is an axial section of the labeling station of FIG. 1 without driving gear or pickup element and taken along line I—I of FIG. 3.

Figure 2:
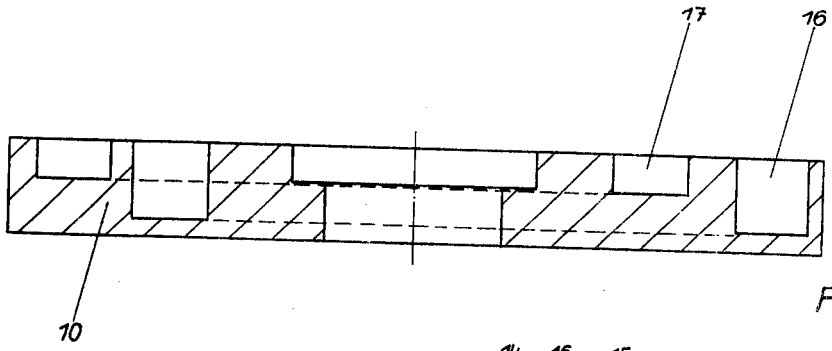
Figure 3:
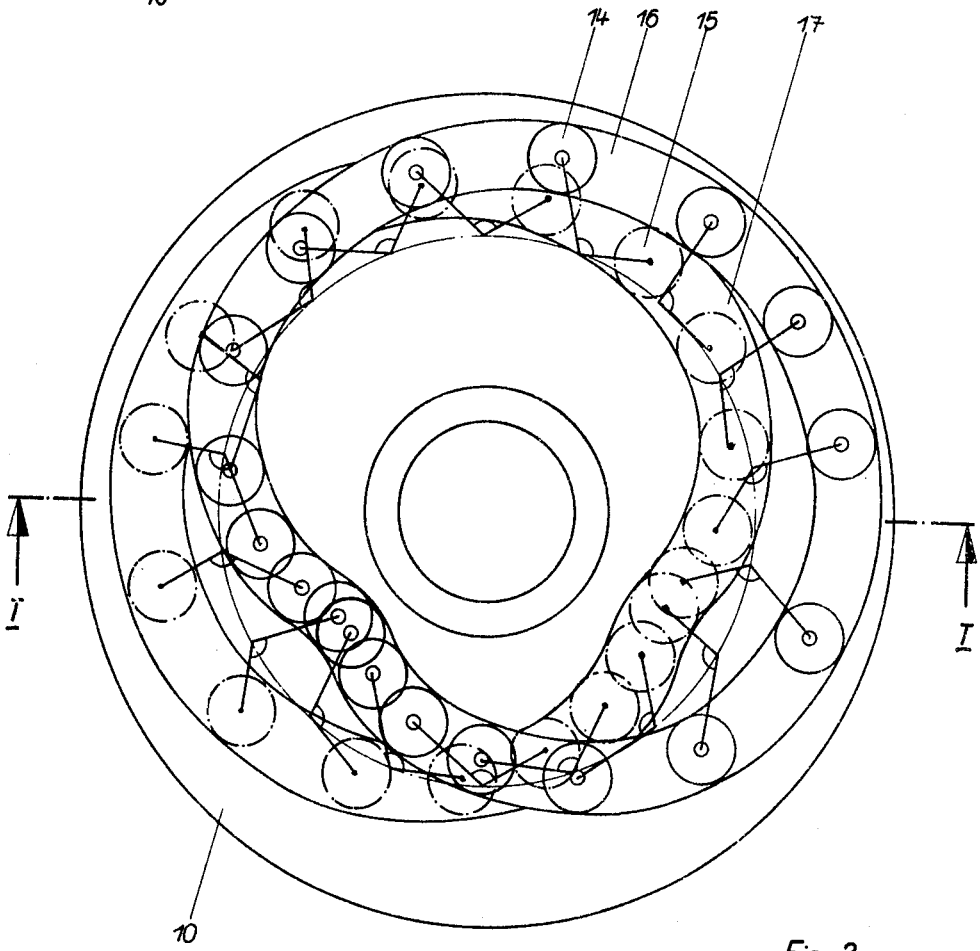
Figure 4:
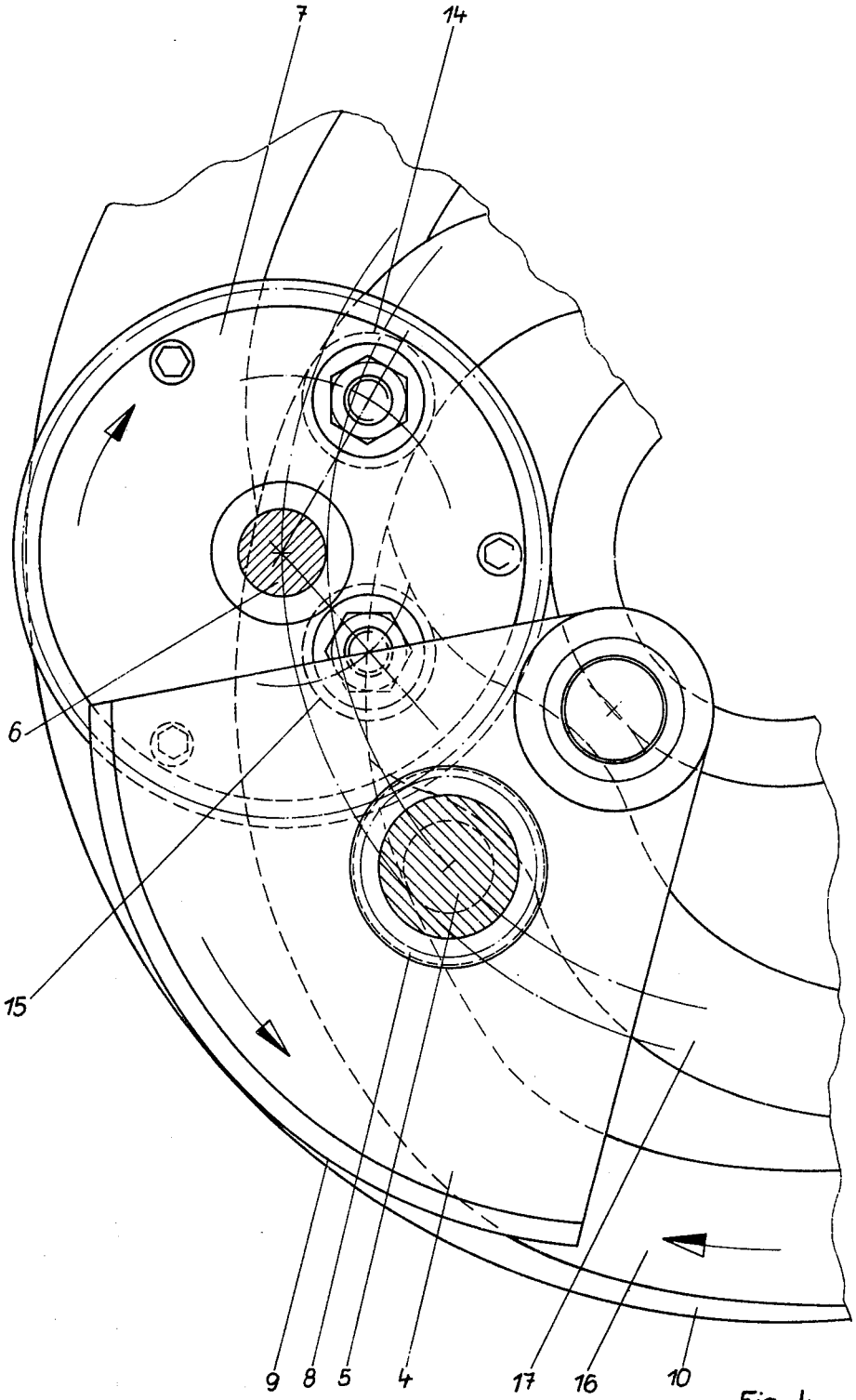
Figure 5:
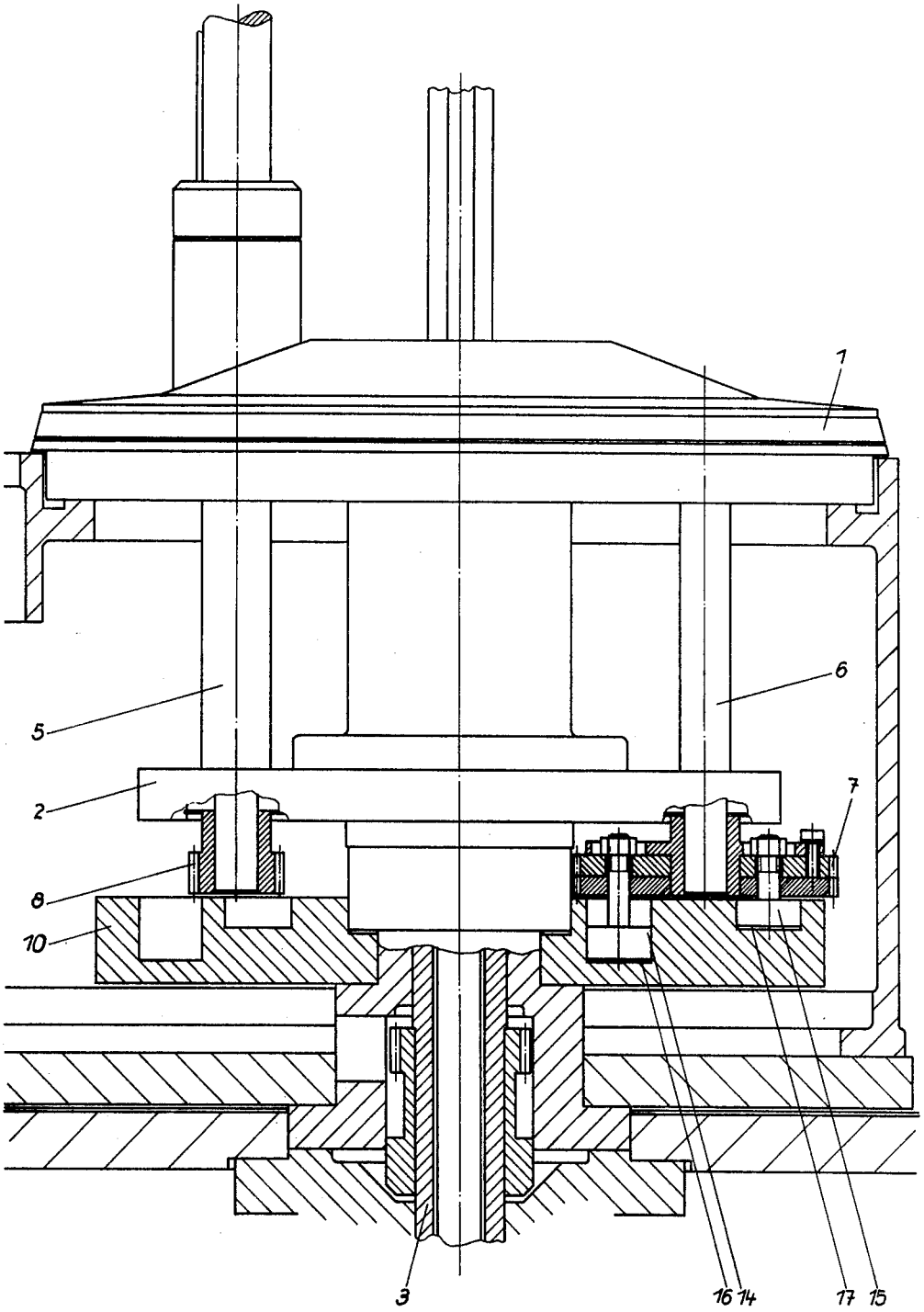
Figure 6:
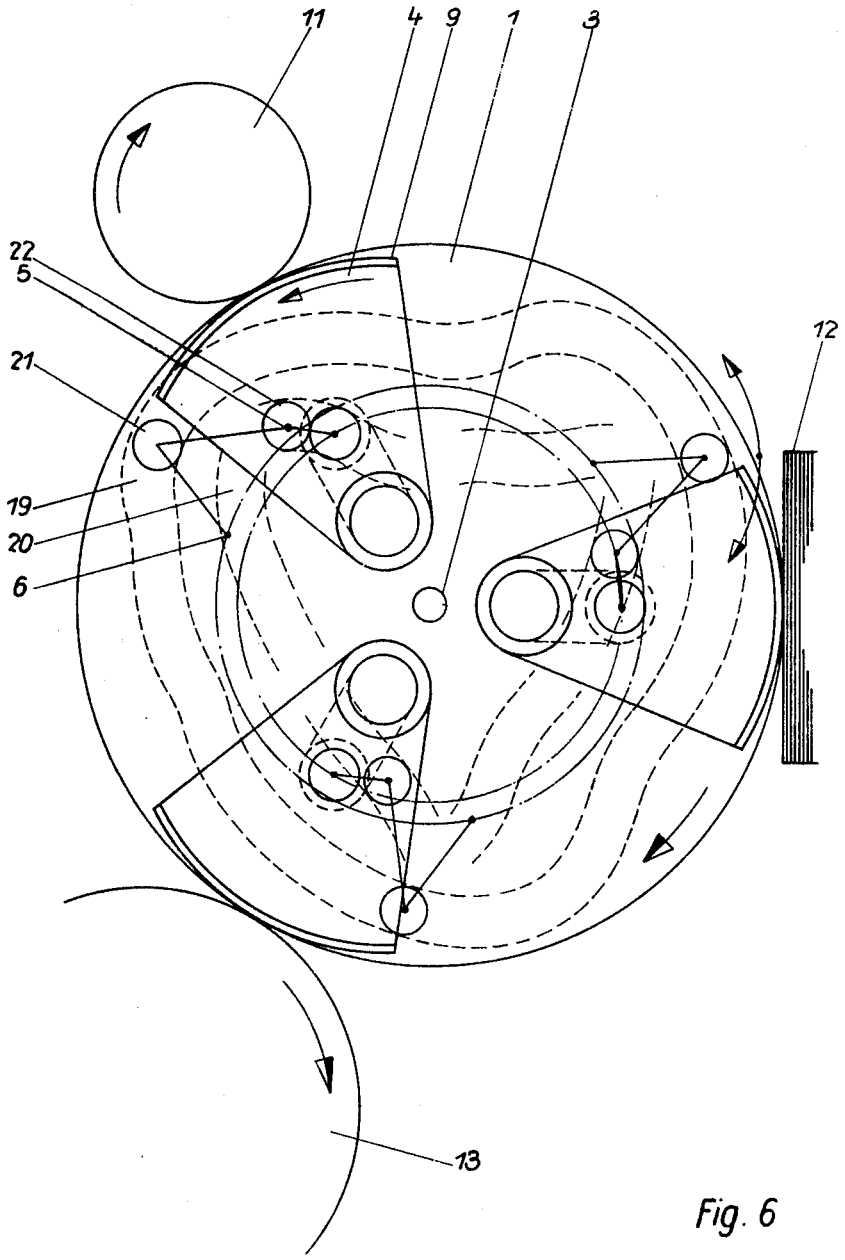
Figure 7:
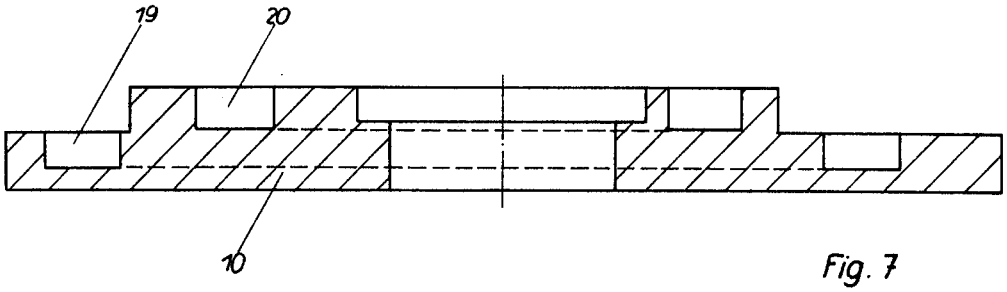
Figure 8:
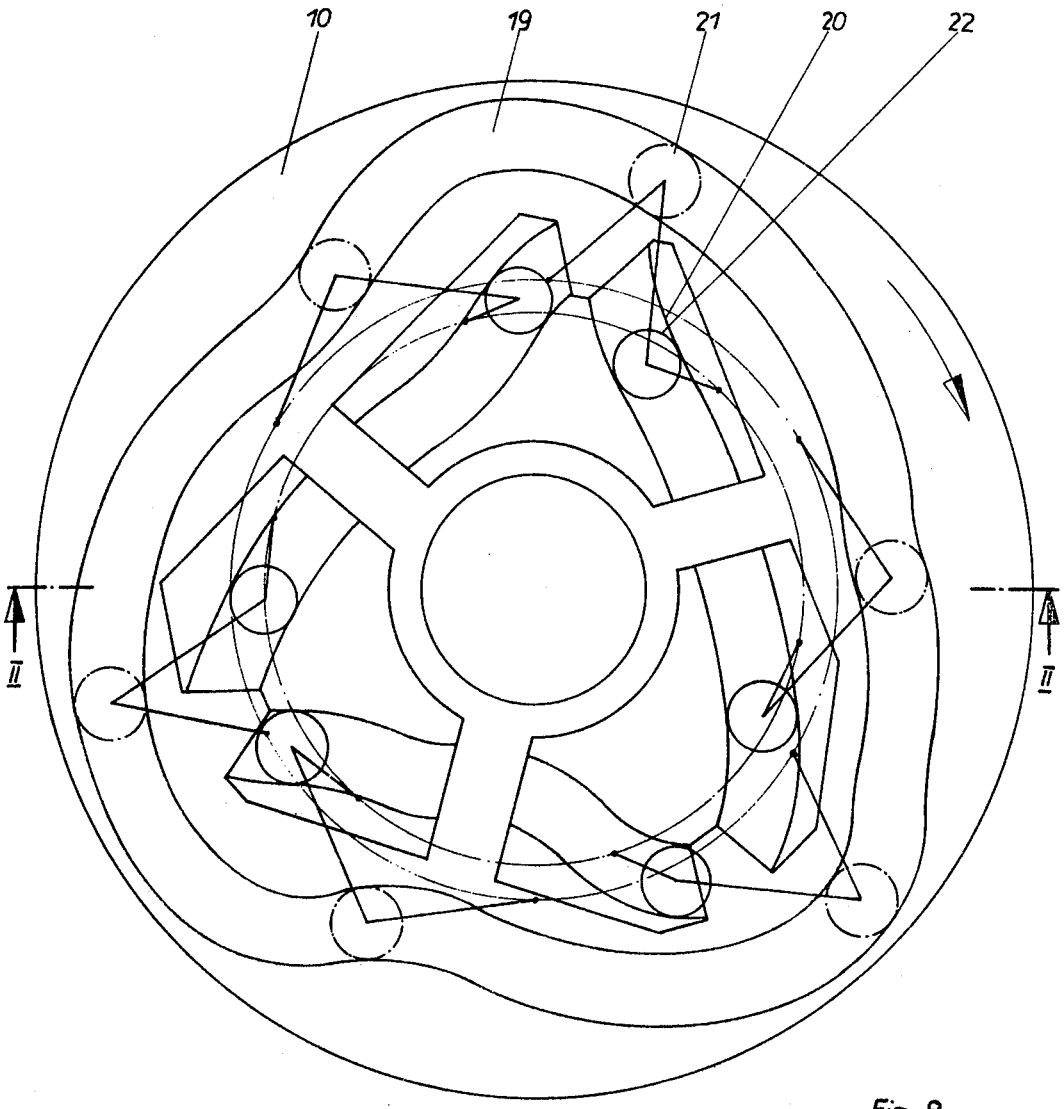
Figure 9:
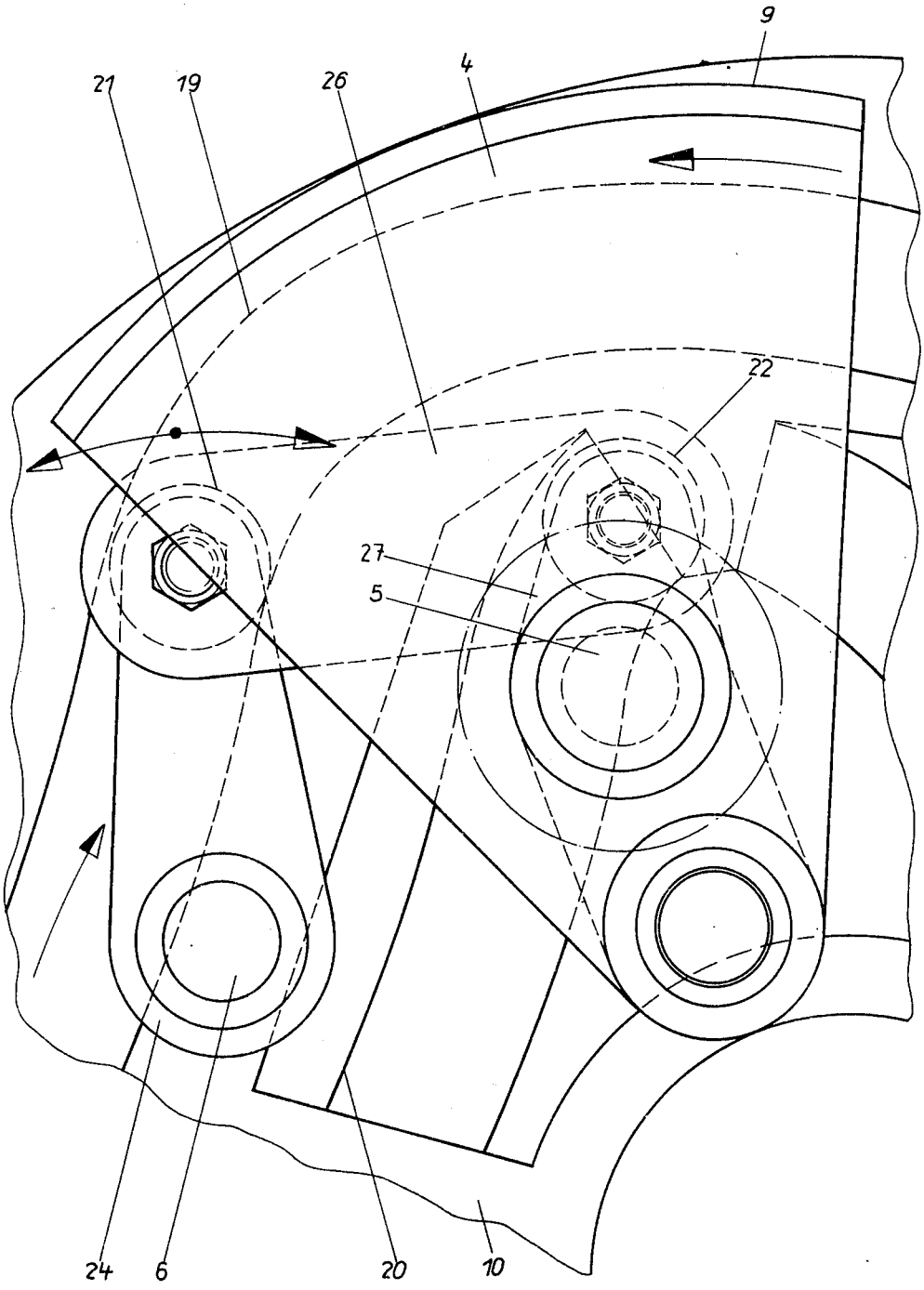
Figure 10:
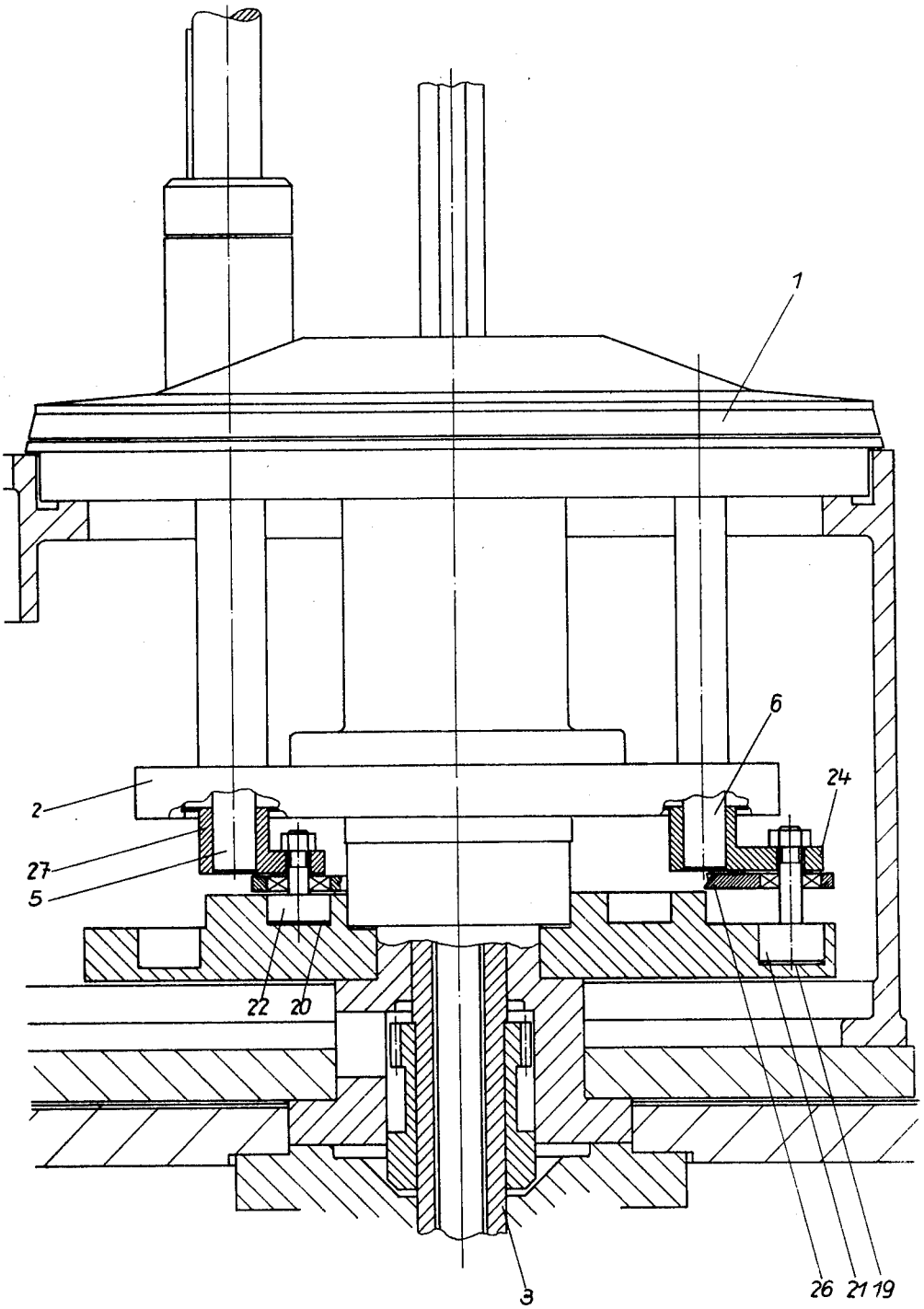

FIG. 3 is a top view of the labeling station of FIG. 1 without the pickup element but with its driving gear in various positions, FIG. 4 is a top view and enlarged representation of one of the pickup elements with driving gear of the labeling station of FIG. 1, FIG. 5 is an axial section through the pickup element with driving gear of FIG. 4, FIG. 6 is a diagrammatic top view of a labeling station of a labeling machine with a driving gear for the pickup elements which is an alternative to the driving gear of FIGS. 1–5, FIG. 7 is an axial section, taken along line II—II of FIG. 8, of a labeling station according to FIG. 6 without driving gear or pickup elements, FIG. 8 is a top view of the labeling station of FIG. 6 without pickup elements but with its driving gear in various positions, FIG. 9 is a top view and enlarged representation of one of the pickup elements with driving gear of the labeling station of FIG. 6, and FIG. 10 is an axial section through the pickup element of FIG. 9.

Referring now more particularly to FIGS. 1 to 5, the labeling station has a support consisting of upper and lower circular plates 1 and 2. The plates 1, 2 are firmly mounted on a driving shaft 3 actuated by driving means, not shown. Between the centrally supported plates 1, 2 there is eccentrically supported at least one label-pickup element 4 with its spindle 5 and, as part of the driving gear of the pickup element 4, a shaft 6 supported at a fixed distance. The plates 1, 2 can serve to support several pickup elements with associated driving gears. FIG. 1 and 6 show three such pickup elements.

Each pickup element 4 has the shape of a cylindrical segment whose driving shaft 5 has been disposed, eccentrically but symmetrically, between the center of the curvature and the cylinder surface. This design and support of the pickup element 4 make it possible, at a corresponding accelerated or decelerated rotary motion and direction of rotation in relation to the individual stations, to obtain a rolling of the surface 9 of the pickup element 4 along the surface of each station.

A glue roller 11 rotating around a fixed shaft, a fixed label magazine 12 and a transfer-roll-off device 13 rotating around a fixed shaft are, evenly distributed, disposed as stations around the central driving shaft 3. When rotating the plates 1, 2 while also rotating each element 4 about its own spindle in the directions indicated, the surface 9 of each pickup element roll along the surfaces of the individual stations 11, 12, 13.

By means of the driving gear according to the invention, two embodiments of which are illustrated in the drawings, substantially perfect rolling of the surface 9 of each pickup element 4 along the surfaces of the individual stations 11, 12, 13 is obtained.

In the drive of the labeling machine according to FIGS. 1–5 there is mounted on the shaft 6 a larger cogwheel 7 which mates with a smaller cogwheel 8 on the shaft 5 of the pickup element 4. Two guide rollers 14, 15 are mounted on the cogwheel 7 as feelers or followers which engage with the curved grooves or tracks 16, 17 on two levels of the top side of a fixed plate 10. As shown in FIG. 3, the feelers 14, 15 have lever arms of different lengths which form an obtuse angle with each other. Due to the length of the lever arms, the magnitude of the angle of the lever arms and the position of the curved grooves, a rotation moment in the same direction is imparted to the cogwheel 7 and consequently also to the pickup element 4, when rotating the support, by the guided motion of the feelers 14, 15 in the curved grooves 16, 17. The acceleration and deceleration required can be regulated by the shape of the curved grooves 16, 17 and adjusted length and angular position of the lever arms. FIG. 3 shows the various positions possible for the guide rollers 14, 15 during the rotation of the support 1, 2. As is shown, the effect of these positions of the guide rollers 14, 15 is that the pickup element 4 is rotated over its whole course in the same direction, in this case clockwise, and thus in the opposite direction to the support 1, 2. The most favorable shape of the curved grooves 16, 17, the length of the lever arms and the angle of the lever arms can be determined by means of a calculator.

Although in the second alternative of the labeling station according to FIGS. 6 to 10 there are also two guide rollers 21, 22 in curved grooves 19, 20, these guide rollers 21, 22 and the drive of the pickup element 4 are associated in a manner which is different from the arrangement of the first alternative. In this embodiment the control member in the form of a crank assembly is constructed in such a manner that the guide roller 21 is pivotally supported by a rigid connecting part 24 about the fixed shaft 6 in the lower plate 2 and is consequently held at a fixed distance from the shaft 6, and in a manner that this guide roller 21 is held at a fixed distance from the second guide roller 22 by means of an additional rigid connecting part 26. Via a lever 27 the second guide roller 22 effects rotation of the shaft 5 of the pickup element 4. As in the former embodiment, it is, of course, possible to include a transmission gear. In this case, too, a maximum adjustment of the position of the curved grooves 19, 20 and the length of the connecting parts 24, 25, 27 can be determined by means of a calculator, so as to effect perfect rolling of the surface 9 of the pickup element along the surfaces of the individual stations during a rotation of the pickup element in the same direction.

These embodiments do not require the curved grooves or cam tracks to be closed, i.e. continuous. For the guided motion of the feelers, it is sufficient if each of the two curved grooves is provided only in those places where the feeler associated with the other curved groove cannot effect rotation of the pickup element. Each feeler then serves to move the other feeler from this dead position to a new position.

It will be appreciated that the instant specification and examples are set forth by way of illustration and not limitation, and that various modifications and changes may be made without departing from the spirit and scope of the present invention.

What is claimed is:

1. In an apparatus of the type having a fixed support having a central axis, a gluing station, a label magazine station and a label transfer station each spaced apart and having a contact surface disposable at a given radial distance from the central axis, the improvement which comprises: a support rotatable with respect to said fixed support about said central axis; at least one pickup element having one arcuate contacting surface and mounted on said rotatable support for rotation about a given axis parallel to said central axis to dispose successive portions of the arcuate contacting surface at said given radial distance from said central axis, and means responsive to the rotation of said rotatable support for effecting one complete rotation of each pickup element successively for each station during one revolution of said rotatable support to produce a successive rolling contact of the arcuate contacting surface with each of the contact surfaces of the stations, said means including at least two intersecting closed cam tracks in said fixed support disposed around said central axis and at least two cam followers associated with each pickup element and each disposed in a different cam track to rotatably drive the associated pickup element as the cam followers travel in the cam tracks when the rotatable support is rotated.

2. An apparatus according to claim 1, wherein said means for effecting rotation further includes for each pickup element, a shaft connected to said fixed support and parallel to said central axis, means connecting the at least two cam followers associated with each pickup element for rotation around said shaft at a fixed distance from said shaft and means rotatably coupling the connected cam followers to the associated pickup element.

3. An apparatus according to claim 2, wherein said means for rotatably coupling includes a transmission gear operatively positioned between said means connecting the cam followers and said pickup element so as to magnify rotational moments imparted by said cam followers.

4. An apparatus according to claim 3, wherein said means connecting the cam followers comprises a crank having two arms each carrying a cam follower and connected to said shaft, the two cam followers carried by said arms being in fixed positions relative to each other and the arms define a fixed angle therebetween.

5. An apparatus according to claim 3, wherein said means connecting the cam followers includes two independent lever arms one end of each of which is pivoted about one of said cam followers, the other end of one arm being operatively connected with the means for rotatably coupling, the other end of the second arm connecting said one cam follower with the other cam follower so that the angle between said arms is variable.

* * * * *